US011795690B2

(12) United States Patent
Ganiev et al.

(10) Patent No.: US 11,795,690 B2
(45) Date of Patent: Oct. 24, 2023

(54) MULTIPURPOSE ANCHOR

(71) Applicant: Galen Panamerica LLC, Dania Beach, FL (US)

(72) Inventors: Zaur Ganiev, Bal Harbour, FL (US); Egor Litvinov, Hallandale Beach, FL (US); Valery Hurynovich, Minsk (BY)

(73) Assignee: Galen Panamerica LLC, Dania Beach, FL (US)

( * ) Notice: Subject to any disclaimer, the term of this patent is extended or adjusted under 35 U.S.C. 154(b) by 0 days.

(21) Appl. No.: 17/558,690

(22) Filed: Dec. 22, 2021

(65) Prior Publication Data

US 2023/0193629 A1 Jun. 22, 2023

(51) Int. Cl.
*E04C 5/20* (2006.01)
*E04C 5/07* (2006.01)

(52) U.S. Cl.
CPC . *E04C 5/20* (2013.01); *E04C 5/07* (2013.01)

(58) Field of Classification Search
CPC ... E04C 5/20; E04C 5/07; E04C 5/208; E04C 5/206; E04C 5/168; E04C 5/162; E04C 5/163
USPC ..... 52/300, 301
See application file for complete search history.

(56) References Cited

U.S. PATENT DOCUMENTS 1,268,887 A * 6/1918 Schroeder ..... E04C 5/18 52/660
1,613,351 A * 1/1927 Klinger ..... E04C 5/168 52/684
4,309,120 A * 1/1982 Werthmann ..... F16B 7/0493 24/339
5,893,252 A * 4/1999 Hardy, Jr. ..... E04C 5/168 52/685
6,866,445 B2 * 3/2005 Semler ..... E01C 23/01 52/678
6,883,289 B2 * 4/2005 Juedes ..... E04C 5/168 52/687
D560,482 S * 1/2008 Casteel ..... D8/395
7,469,515 B2 * 12/2008 Minor ..... E04C 5/167 52/719
7,584,585 B2 * 9/2009 Kilby ..... E04C 5/206 52/682
8,099,925 B1 * 1/2012 Coons ..... E04C 5/20 404/136
8,776,328 B2 * 7/2014 Kodi ..... E04C 5/163 24/339
10,896,774 B2 * 1/2021 Stilwell ..... H02G 15/00
D921,751 S * 6/2021 Fillion ..... D19/85
2006/0188335 A1 * 8/2006 Harris ..... E01C 11/18 404/136
2012/0186149 A1 * 7/2012 Dray ..... A01G 9/12 47/45
2013/0269246 A1 * 10/2013 Kassouni ..... A01G 9/12 47/45
2018/0007843 A1 * 1/2018 Fakhari ..... A01G 9/12

* cited by examiner

*Primary Examiner* — Babajide A Demuren
(74) *Attorney, Agent, or Firm* — Harness, Dickey & Pierce, P.L.C.

(57) ABSTRACT

An anchor for supporting a reinforcing mesh includes an elongated bar having a predetermined length. A cap is mounted on the elongated bar and includes a mounting section with an opening for receiving the elongated bar and a clip section extending from a side of the mounting section and including a flexible slot configured to receive a section of a reinforcing mesh therein.

15 Claims, 5 Drawing Sheets

MULTIPURPOSE ANCHOR

FIELD

The present disclosure relates to a multipurpose anchor for use in various industrial applications.

BACKGROUND

This section provides background information related to the present disclosure which is not necessarily prior art.

Rebar, or reinforcing bar, along with reinforcing mesh are common features of many concrete applications. Its primary purpose is to increase the tensile strength of the concrete, helping it resist cracking and breaking. With greater tensile strength, concrete is better able to resist breaking under tension. There is a need in the art of concrete reinforcement to provide an improved device and method for supporting the mesh or rebar in a desired position.

SUMMARY

This section provides a general summary of the disclosure, and is not a comprehensive disclosure of its full scope or all of its features.

An anchor for supporting a reinforcing mesh includes an elongated bar having a predetermined length. A cap is mounted on the elongated bar and includes a mounting section with an opening for receiving the elongated bar and a clip section extending from a side of the mounting section and including a flexible slot configured to receive a section of a reinforcing mesh therein.

According to a further aspect, an anchor for supporting an architectural structure includes an elongated bar having a predetermined length. A cap is mounted on the elongated bar, the cap including a mounting section with an opening for receiving the elongated bar and a pair of clip sections extending from a side of the mounting section and each including a flexible slot configured to receive a section of an elongated member.

According to yet another aspect, an anchor for supporting an architectural structure includes a hub member including a plurality of arms extending from the hub member. A plurality of clip members are disposed at the ends of the plurality of arms, each of the clip members including a flexible slot configured to receive an elongated member.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
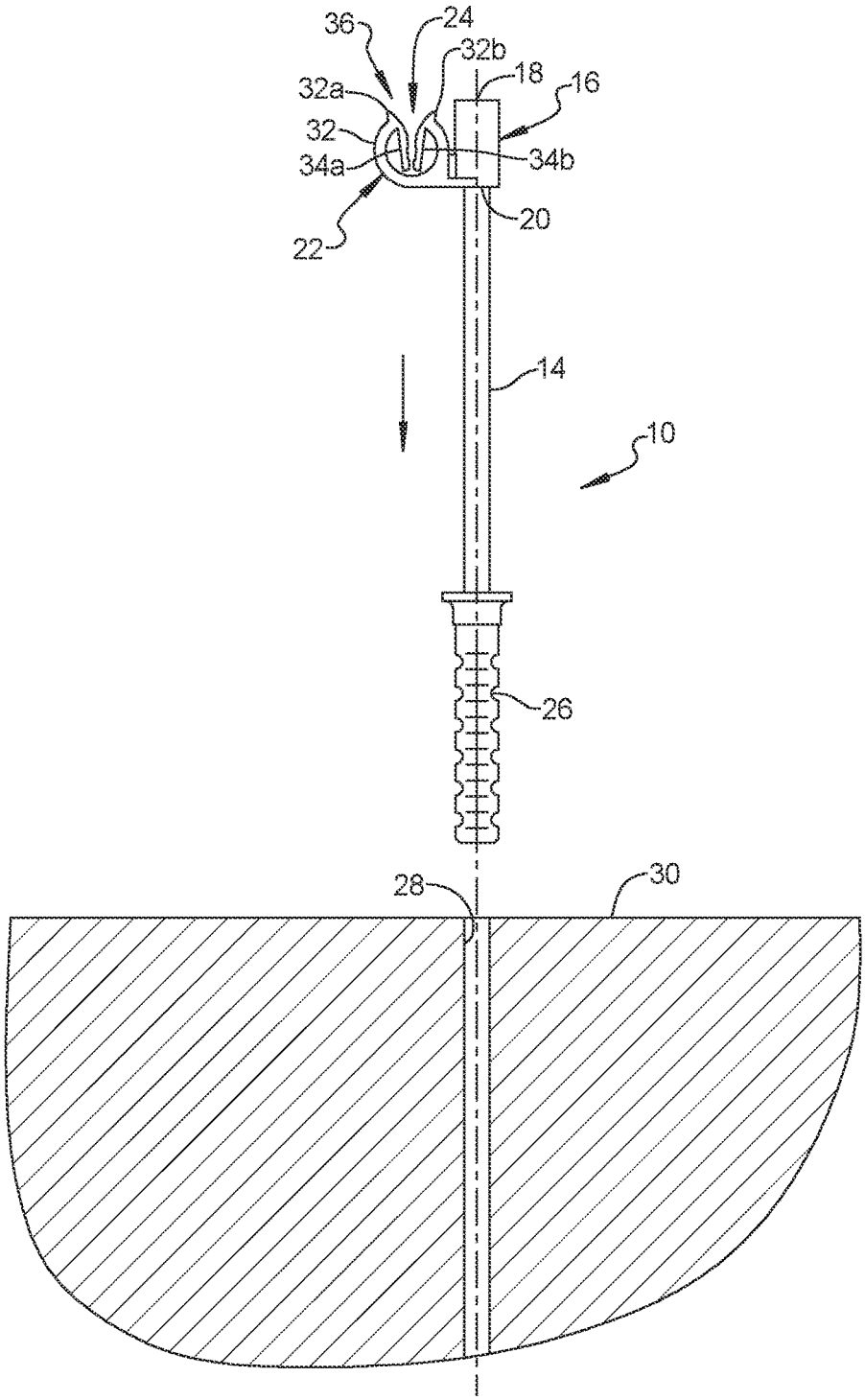
FIG. 1 is a plan view of an anchor according to the principles of the present disclosure being secured to a base structure.
Figure 2:
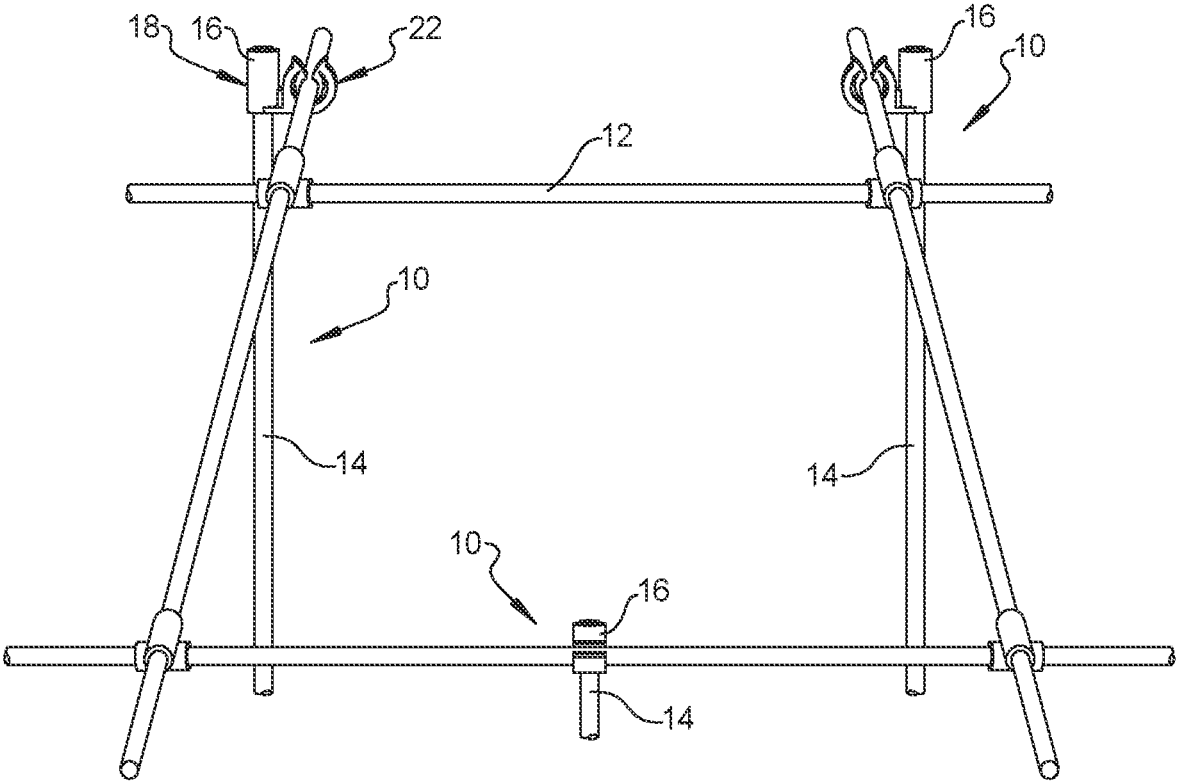
FIG. 2 is a top perspective view of a reinforcing mesh supported by the anchor of the present disclosure.
Figure 3:
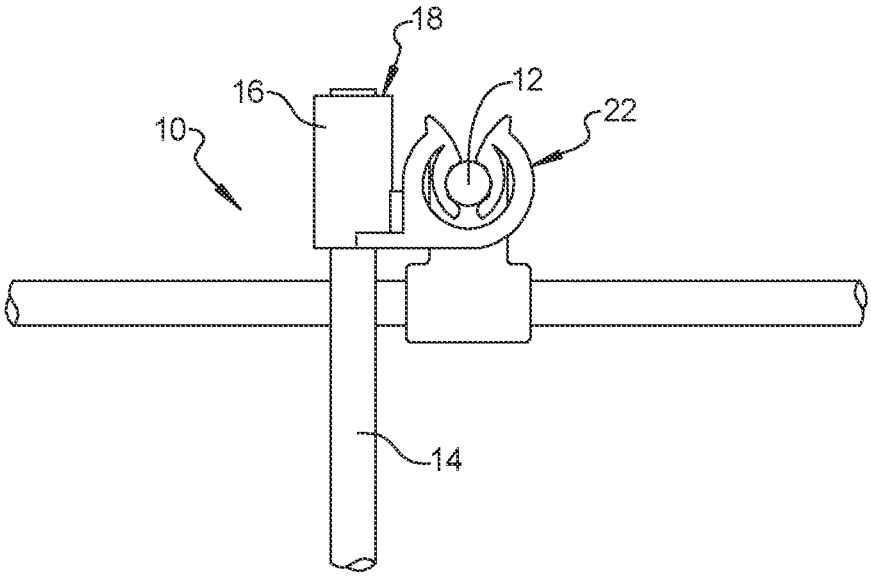
FIG. 3 is a side perspective view of the anchor supporting a reinforcing mesh according to the principles of the present disclosure.

With reference to FIG. 1-3, a multipurpose anchor 10 for supporting a section of a reinforcing mesh 12 according to the principles of the present disclosure is shown. The anchor 10 includes an elongated bar 14 having a predetermined length. A cap 16 is mounted on the elongated bar 14 and includes a mounting section 18 with an opening 20 for receiving the elongated bar 14 and a clip section 22 extending from a side of the mounting section 18 and including a flexible slot 24 configured to receive a section of a reinforcing mesh or rod therein. The anchor 10 is a unique fastening element which can be used in various industrial sectors.

The bar 14 is preferably a glass fiber reinforced polymer reinforcing bar. The bar 14 can have a pointed tip or a flat tip on the end opposite to the cap 16. The bar can also be received in an optional mounting sleeve 26 that can be inserted in a drilled or bored hole 28 within a structure 30. Alternatively, a free end of the bar 14 of the anchor 10 can be pushed or pounded into the ground or another surface or structure.

The anchor 10 can include one or more polymer caps 16 made by injection molding. Depending on an application, the cap 16 can be made from polypropylene, polyethylene, rubber, glass fiber filled polymers or other plastic material. As best shown in FIG. 1, the clip section 22 can include a partial annular body 32. The ends 32*a*, 32*b* of the partial annular body 32 each support a flexible arm 34*a*, 34*b* that define the flexible slot 24. The slot 24 between each of the flexible arms 34*a*, 34*b* includes a beveled opening 36 exterior to the partial annular body. The beveled opening 36 allows for easy engagement of a section of a rebar or mesh with the clip section 22 (see FIGS. 2 and 3). Each of the flexible arms 34*a*, 34*b* have a free end movably disposed within the partial annular body 32. When a section of a mesh or rebar 12 is inserted into the slot 24 of the clip section 22, the beveled opening 26 guides the section of the mesh or rebar into a center position within the slot 24.

The diameter of the bar 14 can be from 4 mm to 10 mm (0.157 to 0.394 inches) depending on loads taken by the anchor 10. The anchor 10 can be manufactured of any length and the bar's surface can have a sand coating.

Figure 5:
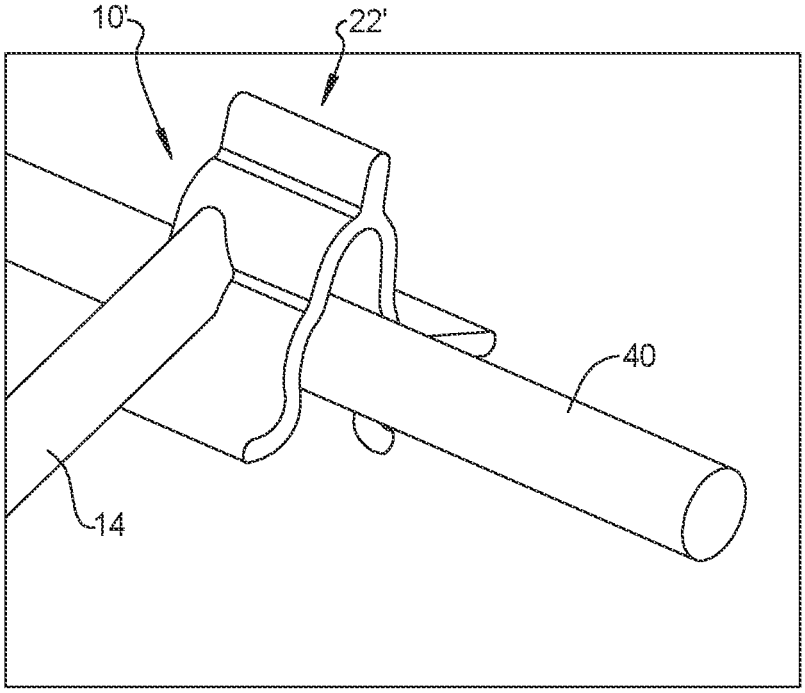
FIG. 5 is a perspective view of an alternative anchor having a predetermined sized clip.

The multipurpose anchor 10 for mesh fastening has the design allowing fastening bars of various diameters—from 2.2 mm to 8 mm (0.086 to 0.314 inches). The flexible arms 34*a*, 34*b* and the partial annular body 32 flex to accommodate different diameter bars or mesh. Alternatively, as shown in FIG. 5, the clip section 22' of the anchor 10' can be designed to fasten certain bars of a certain diameter only.

In construction, the anchor 10 can be used for fastening a mesh 12 to a base structure. The anchor 10 suits for brickwork, concrete and other construction materials and structures, as shown in FIG. 1. The anchor 10 can be installed in a base structure before mesh placement by drilling holes 28 in the base structure, putting the sleeve 26 in the hole 28 and hammering the anchor in the holes 28. A mesh 12 or rebar can then be fixed within the slot 24 of the clip section. In case a base is not rigid enough (such as a sandy or gravel ground surface), the anchor 10 can be installed after mesh placement, by laying out a necessary amount of mesh sheets and installing the anchors 10 forcing them in to the base structure until the mesh's bars are fully fixed in the slot 24 of the cap 16.

Figure 4:
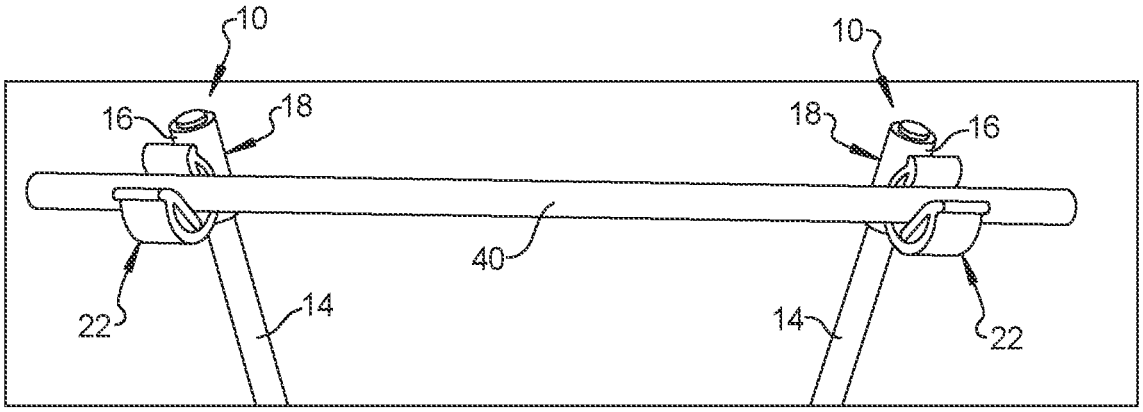
FIG. 4 is a schematic view of a pair of anchors supporting a bar for defining an enclosure.

Besides mesh, it is possible to fasten the anchors 10 to individual reinforcing bars 40 and any round or oval section elements, as shown in FIG. 4. In case a ready-to-use mesh is not available, it is possible to use the anchor 10 with two caps 16 arranged perpendicularly to each other. The bars 40 are then fixed in the caps 16 at a required distance from a base, thus repeating a mesh pattern.

In agriculture, the anchors 10 can be used for forming a wired-in enclosure for cattle and fastening mesh in decorative enclosures.

Figure 8:
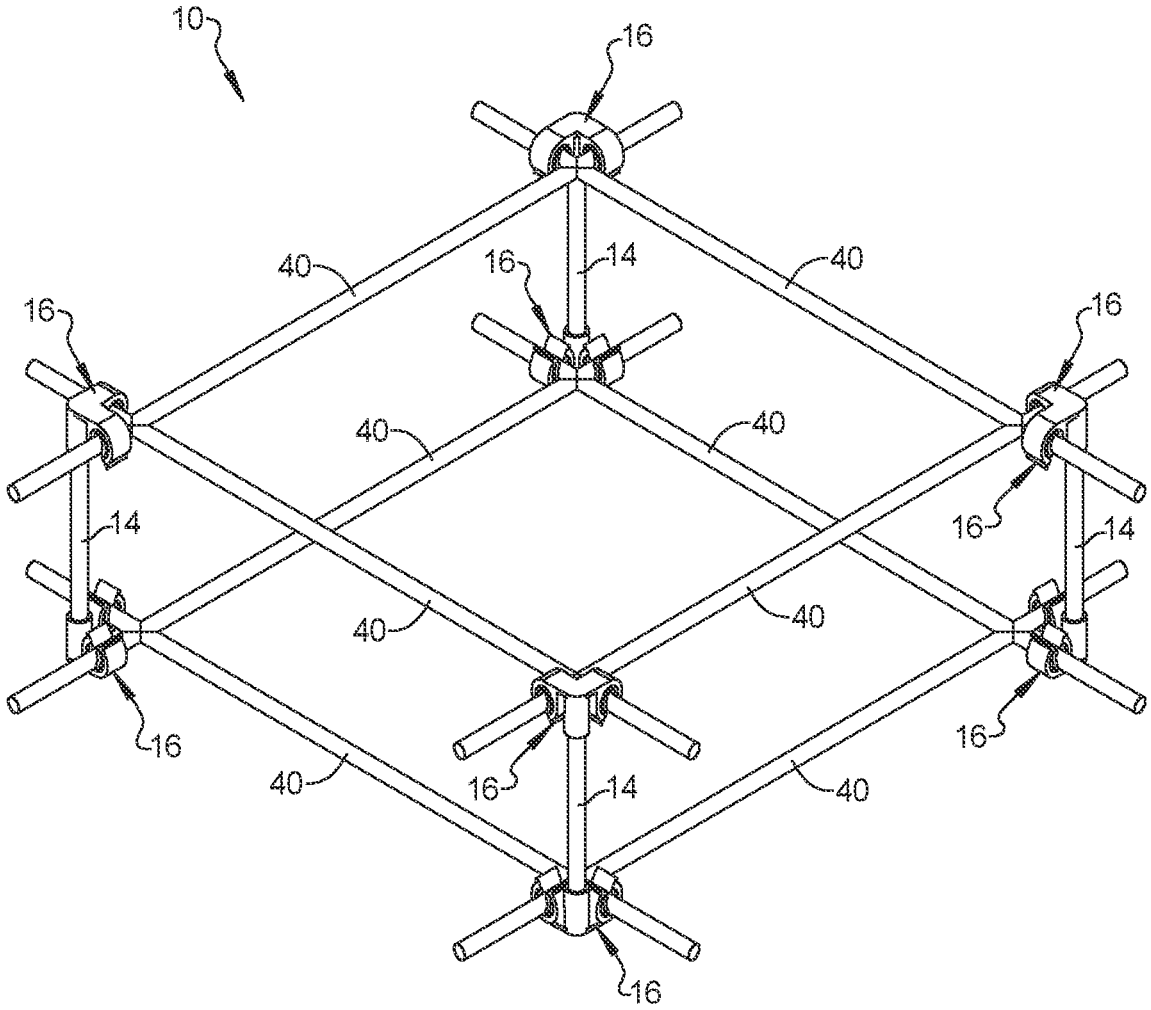
FIG. 8 is a perspective view of a cage structure formed using yet a further alternative anchor design according to the principles of the present disclosure.

The glass fiber reinforced polymer (GFRP) material the bar 14 is made from and a polymer cap make enclosures light-weight, nearly invisible and easy-to-install structures. Multiple uses do not lead to loss of consumer performance which is an attractive advantage for temporary or mobile enclosures. In architectural structures with the use of the anchor with multiple clips 16 it is possible to create various special shapes including: rectangular cages from mesh and cages from bars of various configurations, as shown in FIG. 8.

Figure 6:
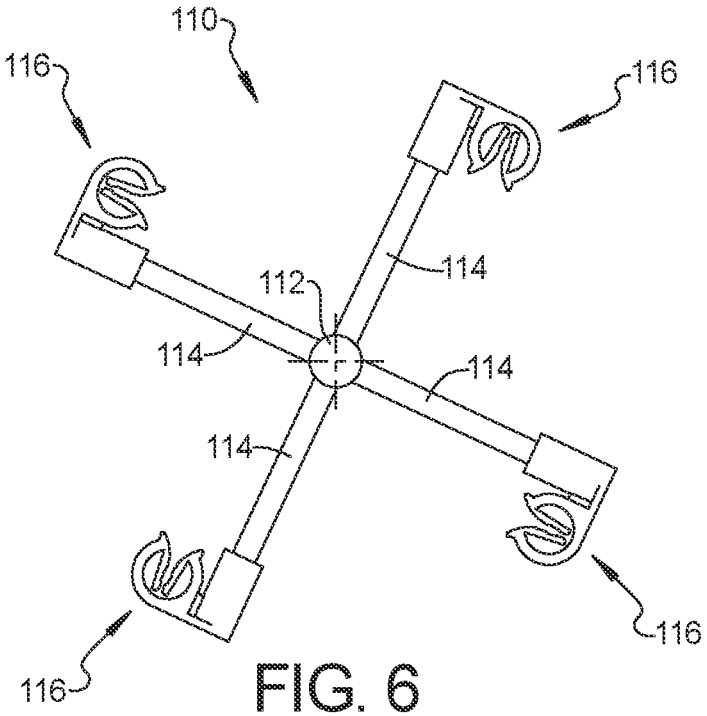
FIG. 6 is a plan view of an alternative anchor for making an architectural structure.
Figure 7:
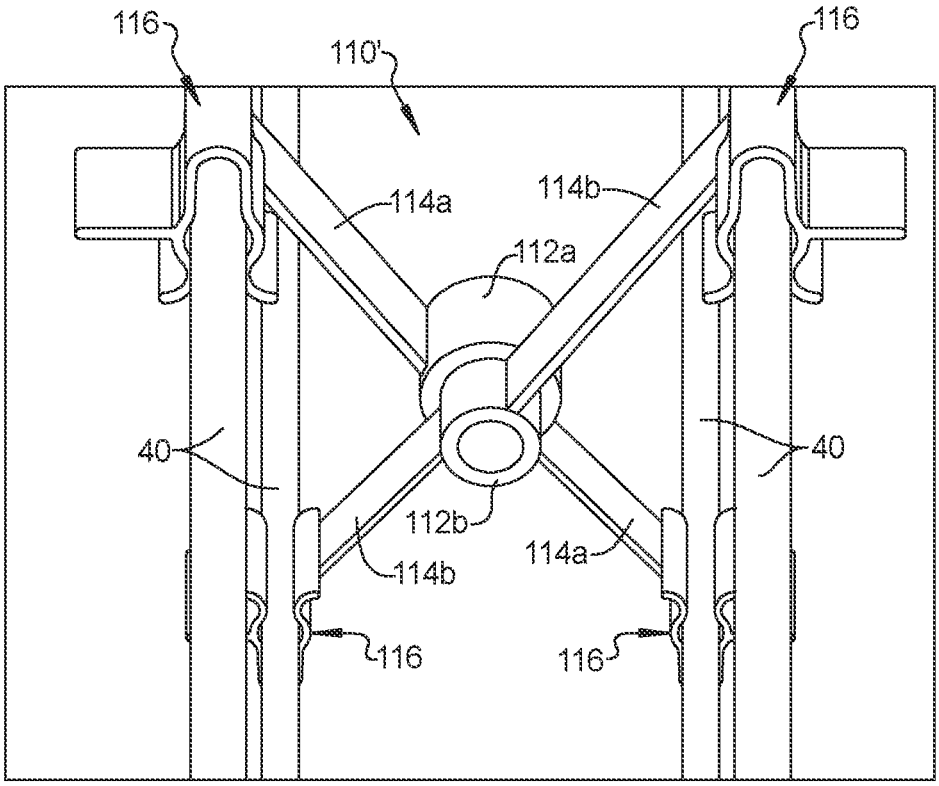
FIG. 7 is a perspective view of an architectural structure formed with the anchor of FIG. 6.

As shown in FIGS. 6 and 7, an alternative anchor 110 is shown including a hub member 112 including a plurality of arms 114 extending from the hub member 112. A plurality of clip members 116 are disposed at the ends of the plurality of arms 114. Each of the clip members 116 include a flexible slot 118 configured to receive an elongated member. The clip members 116 can be configured the same as clip section 22 (see FIG. 6) or alternatively the same as clip sections 22' (see FIG. 7). With reference to FIG. 7, the hub member can include a first hollow hub member 112*a* including two arms 114*a* extending therefrom and a second cylindrical hub member 112*b* including two arms 114*b* extending therefrom and received in the first hollow hub member 112*a*. The second cylindrical hub member 112*b* can be snap fit or otherwise secured within the first hollow hub member 112*a* and can be pivoted relative thereto to allow the anchor 110' to be folded flat for shipping and to be pivoted to a desired angle including but also other than 90 degrees. The snap fit engagement can include a raised rib on either of the first and second hub member 112*a*, 112*b* engaging a corresponding recessed groove on the other of the first and second hub member 112*a*, 112*b*. As shown in FIG. 7, bars 40 are engaged with each clip section 116 in order to define a cage structure. These cages can be used during manufacture of decorative posts, thin wall arcs and rectangular cages.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An anchor for supporting a reinforcing mesh, comprising:

an elongated bar having a predetermined length;

a cap mounted on the elongated bar, the cap including a mounting section with an opening for receiving the elongated bar and a clip section extending from a side of the mounting section, wherein the clip section includes a partial annular body with a pair of ends spaced from one another, each of the pair of spaced ends supporting a respective one of a pair of flexible arms that each extend toward an interior of the partial annular body, the pair of flexible arms define a gap therebetween.

2. The anchor according to claim 1, wherein the cap is made from one of polypropylene, polyethylene, rubber and glass fiber filled polymer.

3. The anchor according to claim 1, wherein the elongated bar is made from glass fiber reinforced polymer.

4. The anchor according to claim 1, wherein the clip section includes a beveled opening exterior to the partial annular body.

5. The anchor according to claim 4, wherein each of the flexible arms have a free end movably disposed within the partial annular body.

6. The anchor according to claim 1, further comprising a sleeve disposed on an end of the elongated bar opposite the cap.

7. An anchor for supporting an architectural structure, comprising:

an elongated bar having a predetermined length;

a cap mounted on the elongated bar, the cap including a mounting section with an opening extending along a first axis for receiving an end of the elongated bar and a pair of clip sections integrally formed with and extending from a side of the mounting section and each of the pair of clip sections including a slot configured to receive a section of an elongated member, a first one of the pair of clip sections extending from the mounting section in a first direction perpendicular to the first axis and a second one of the pair of clip sections extending from the mounting section in a second direction that is perpendicular to the first axis and perpendicular to the first direction;

wherein the pair of clip sections each include a beveled opening exterior to the partial annular body; and wherein each of the flexible arms have a free end movably disposed within the partial annular body.

8. The anchor according to claim 7, wherein the cap is made from one of polypropylene, polyethylene, rubber and glass fiber filled polymer.

9. The anchor according to claim 7, wherein the elongated bar is made from glass fiber reinforced polymer.

10. An anchor for supporting an architectural structure, comprising:

a hub member including four arms extending radially in four different directions relative to a center axis of the hub member; and a plurality of clip members disposed at the ends of each of the respective four arms, each of the clip members including a slot configured to receive a respective one of four elongated members that extend in a direction parallel to the center axis of the hub member.

11. The anchor according to claim 10, wherein the plurality of clip members are made from one of polypropylene, polyethylene, rubber and glass fiber filled polymer.

12. The anchor according to claim 10, wherein the clip members include a partial annular body with ends of the partial annular body each supporting a flexible arm that define the slot.

13. The anchor according to claim 12, wherein the slot between each of the flexible arms includes a beveled opening exterior to the partial annular body.

14. The anchor according to claim 12, wherein each of the flexible arms have a free end movably disposed within the partial annular body.

15. An anchor for supporting an architectural structure, comprising:

a hub member including four arms extending radially in four different directions from the hub member; and a plurality of clip members disposed at the ends of each of the respective four arms, each of the clip members including a slot configured to receive an elongated member; and wherein the hub member includes a first hub portion including a first two of said four arms extending therefrom and a second hub portion including a second two of said four arms extending therefrom and pivotally mounted relative to the first hub portion.

* * * * *